US007860709B2

(12) United States Patent
Mäkinen

(10) Patent No.: US 7,860,709 B2
(45) Date of Patent: Dec. 28, 2010

(54) AUDIO ENCODING WITH DIFFERENT CODING FRAME LENGTHS

(75) Inventor: Jari Mäkinen, Tampere (FI)

(73) Assignee: Nokia Corporation, Espoo (FI)

( * ) Notice: Subject to any disclaimer, the term of this patent is extended or adjusted under 35 U.S.C. 154(b) by 1024 days.

(21) Appl. No.: 11/129,662

(22) Filed: May 13, 2005

(65) Prior Publication Data

US 2005/0267742 A1 Dec. 1, 2005

(30) Foreign Application Priority Data

May 17, 2004 (WO) ..... PCT/IB2004/001585

(51) Int. Cl.
*G10L 19/00* (2006.01)

(52) U.S. Cl. ..... 704/219; 704/500; 704/501; 704/E19.001; 704/E19.01; 704/E19.011; 704/201; 704/203; 704/220

(58) Field of Classification Search ..... 704/219, 704/500, 501, E19.001, E19.01, E19.011, 704/201, 203, 220; 11/219
See application file for complete search history.

(56) References Cited

U.S. PATENT DOCUMENTS 5,235,623 A * 8/1993 Sugiyama et al. ..... 375/241
5,327,518 A * 7/1994 George et al. ..... 704/211
5,394,473 A * 2/1995 Davidson ..... 704/200.1
5,481,614 A * 1/1996 Johnston ..... 381/2
5,490,130 A * 2/1996 Akagiri ..... 369/124.08
5,732,389 A * 3/1998 Kroon et al. ..... 704/223
5,913,191 A * 6/1999 Fielder ..... 704/230
5,963,897 A * 10/1999 Alpuente et al. ..... 704/219
6,134,518 A * 10/2000 Cohen et al. ..... 704/201
6,424,936 B1 * 7/2002 Shen et al. ..... 704/200.1
6,449,590 B1 * 9/2002 Gao ..... 704/219

(Continued)

FOREIGN PATENT DOCUMENTS

EP 1278184 1/2003

OTHER PUBLICATIONS

Tancerel et al., 2000 Tancerel, L., Ragot, S., Ruoppila, V.T., Lefebvre, R., 2000. Combined speech and audio coding by discrimination. Proceedings of IEEE Workshop on Speech Coding, pp. 17-20.*

(Continued)

*Primary Examiner*—Richemond Dorvil
*Assistant Examiner*—Greg A Borsetti
(74) *Attorney, Agent, or Firm*—Alfred A. Fressola; Ware, Fressola, Van Der Sluys & Adolphson LLP

(57) ABSTRACT

The invention relates to a method for supporting an encoding of an audio signal, wherein at least one section of the audio signal is to be encoded with a coding model that allows the use of different coding frame lengths. In order to enable a simple selection of the respectively best suited coding frame length, it is proposed that at least one control parameter is determined based on signal characteristics of the audio signal. The control parameter is then used for limiting the options of possible coding frame lengths for the at least one section. The invention relates equally to a module 10,11 in which this method is implemented, to a device 1 and a system comprising such a module 10,11, and to a software program product including a software code for realizing the proposed method.

35 Claims, 4 Drawing Sheets

U.S. PATENT DOCUMENTS

| | | | | |
|---|---|---|---|---|
| 6,604,070 | B1 * | 8/2003 | Gao et al. | 704/222 |
| 6,633,841 | B1 * | 10/2003 | Thyssen et al. | 704/233 |
| 6,654,716 | B2 * | 11/2003 | Bruhn et al. | 704/219 |
| 6,658,383 | B2 * | 12/2003 | Koishida et al. | 704/229 |
| 7,277,849 | B2 * | 10/2007 | Streich et al. | 704/229 |
| 7,286,982 | B2 * | 10/2007 | Gersho et al. | 704/223 |
| 7,460,993 | B2 * | 12/2008 | Chen et al. | 704/230 |
| 2002/0049583 | A1 * | 4/2002 | Bruhn et al. | 704/203 |
| 2003/0004711 | A1 * | 1/2003 | Koishida et al. | 704/223 |
| 2003/0009325 | A1 * | 1/2003 | Kirchherr et al. | 704/211 |
| 2003/0182105 | A1 * | 9/2003 | Sall et al. | 704/206 |
| 2004/0064312 | A1 * | 4/2004 | Ansorge et al. | 704/219 |
| 2004/0088160 | A1 * | 5/2004 | Manu | 704/203 |
| 2005/0004793 | A1 * | 1/2005 | Ojala et al. | 704/219 |
| 2005/0071402 | A1 * | 3/2005 | Youn | 708/402 |
| 2005/0149322 | A1 * | 7/2005 | Bruhn et al. | 704/211 |
| 2005/0240399 | A1 | 10/2005 | Makinen | |

OTHER PUBLICATIONS

W. Granzow and B. S. Atal, "High-Quality Digital Speech at 4 kbls," Proc. Global Telecomm. Conf. (GLOBECOM), pp. 941-945 (1990).*

B. Bessette, R. Salami, R. Lefebvre, M. Jel'inek, J. Rotola- Pukkila, J. Vainio, H. Mikkola, and K. J"arvinen, "The adaptive multirate wideband speech codec (AMR-WB)", IEEE Trans. Speech Audio Processing, vol. 10, No. 8, pp. 620-636, Nov. 2002.*

A. Sugiyama, F. Hazu, M. Iwadare, and T. Nishitani. Adaptive transform coding with an adaptive block size (ATC-ABS). In Proc. IEEE Int. Conf. Acoust., Speech, Signal Processing, pp. 1093-1096, Albuquerque, New Mexico, Apr. 1990.*

I. Vargas. "Audio Codec for Mobile Multimedia Application" 2004 IEEE.*

Stefan Bruhn. "Bridging the gap between speech and audio coding AMR-WB+—The codec for mobile audio" May 10, 2004.*

Makinen et al. "Source signal based rate adaptation for GSM AMR speech codec" 2004 IEEE.*

Salami et al. "A Wideband Codec AT 16/24 KBT/S With 10 MS Frames" 1997 IEEE.*

"A Wideband Speech and Audio Codec At 16/24/32 KBIT/S Using Hybrid ACELP/TCX Techniques;" B. Bessette et al; IEEE, 1999.

"3GPP; Technical Specification Group Services and System Aspects; Speech Codec Speech Processing Functions; AMR Wideband Speech Codec; Transcoding Functions (Release 5);" 3GPP TS 26.190, V5.1.0; Dec. 2001.

"Bridging the gap between speech and audio coding; AMR—WB+—The codec for mobile audio;" Stefan Bruhn; Ericsson; May 10, 2004; pp. 30-33.

* cited by examiner

| Selected mode combination after open-loop mode selection (TCX = 1 and ACELP = 0) | Possible frame length combinations (ACELP = 0, TCX20 = 1, TCX40 = 2 and TCX80 = 3) | | Control parameters | |
|---|---|---|---|---|
| | | | ***Aind*** | ***NoMtcx*** |
| (0, 1, 1, 1) | (0, 1, 1, 1) | (0, 1, 2, 2) | 1 | - |
| (1, 0, 1, 1) | (1, 0, 1, 1) | (1, 0, 2, 2) | 1 | - |
| (1, 1, 0, 1) | (1, 1, 0, 1) | (2, 2, 0, 1) | 1 | - |
| (1, 1, 1, 0) | (1, 1, 1, 0) | (2, 2, 1, 0) | 1 | - |
| (1, 1, 0, 0) | (1, 1, 0, 0) | (2, 2, 0, 0) | 2 | - |
| (0, 0, 1, 1) | (0, 0, 1, 1) | (0, 0, 2, 2) | 2 | - |
| (1, 1, 1, 1) | (1, 1, 1, 1) | | 0 | 1 |
| (1, 1, 1, 1) | (2, 2, 2, 2) | (3, 3, 3, 3) | 0 | 0 |

Fig. 3

| Selected mode combination after open-loop mode selection (TCX = 1 and ACELP = 0) | Possible frame length combinations (ACELP = 0, TCX20 = 1, TCX40 = 2 and TCX80 = 3) | | Control parameters | |
|---|---|---|---|---|
| | | | ***Aind*** | ***NoMtcx*** |
| (0, 1, 1, 1) | (0, 1, 1, 1) | (0, 1, 2, 2) | 1 | - |
| (1, 0, 1, 1) | (1, 0, 1, 1) | (1, 0, 2, 2) | 1 | - |
| (1, 1, 0, 1) | (1, 1, 0, 1) | (2, 2, 0, 1) | 1 | - |
| (1, 1, 1, 0) | (1, 1, 1, 0) | (2, 2, 1, 0) | 1 | - |
| (1, 1, 0, 0) | (1, 1, 0, 0) | (2, 2, 0, 0) | 2 | - |
| (0, 0, 1, 1) | (0, 0, 1, 1) | (0, 0, 2, 2) | 2 | - |
| (1, 1, 1, 1) | (1, 1, 1, 1) | (2, 2, 2, 2) | 0 | 1 |
| (1, 1, 1, 1) | (2, 2, 2, 2) | (3, 3, 3, 3) | 0 | 0 |

Fig. 4

AUDIO ENCODING WITH DIFFERENT CODING FRAME LENGTHS

CROSS-REFERENCE TO RELATED APPLICATION

This application claims priority under 35 USC §119 to International Patent Application No. PCT/IB2004/001585 filed on May 17, 2004.

FIELD OF THE INVENTION

The invention relates to a method for supporting an encoding of an audio signal, wherein at least one section of said audio signal is to be encoded with a coding model that allows the use of different coding frame lengths. The invention relates equally to a corresponding module, to a corresponding electronic device, to a corresponding system and to a corresponding software program product.

BACKGROUND OF THE INVENTION

It is known to encode audio signals for enabling an efficient transmission and/or storage of audio signals.

An audio signal can be a speech signal or another type of audio signal, like music, and for different types of audio signals different coding models might be appropriate.

A widely used technique for coding speech signals is the Algebraic Code-Excited Linear Prediction (ACELP) coding. ACELP models the human speech production system, and it is very well suited for coding the periodicity of a speech signal. As a result, a high speech quality can be achieved with very low bit rates. Adaptive Multi-Rate Wideband (AMR-WB), for example, is a speech codec that is based on the ACELP technology. AMR-WB has been described for instance in the technical specification 3GPP TS 26.190: "Speech Codec speech processing functions; AMR Wideband speech codec; Transcoding functions", V5.1.0 (2001-12). Speech codecs which are based on the human speech production system, however, perform usually rather badly for other types of audio signals, like music.

A widely used technique for coding other audio signals than speech is transform coding (TCX). The superiority of transform coding for audio signal is based on perceptual masking and frequency domain coding. The quality of the resulting audio signal can be further improved by selecting a suitable coding frame length for the transform coding. But while transform coding techniques result in a high quality for audio signals other than speech, their performance is not good for periodic speech signals. Therefore, the quality of transform-coded speech is usually rather low, especially with long TCX frame lengths.

The extended AMR-WB (AMR-WB+) codec encodes a stereo audio signal as a high bitrate mono signal and provides some side information for a stereo extension. The AMR-WB+ codec utilizes both, ACELP coding and TCX models to encode the core mono signal in a frequency band of 0 Hz to 6400 Hz. For the TCX model, a coding frame length of 20 ms, 40 ms or 80 ms is utilized.

Since an ACELP model can degrade the audio quality and transform coding performs usually poorly for speech, especially when long coding frames are employed, the respectively best coding model has to be selected. The selection of the coding model that is actually to be employed can be carried out in various ways.

In systems requiring low complex techniques, like mobile multimedia services (MMS), usually music/speech classification algorithms are exploited for selecting the optimal coding model. These algorithms classify the entire source signal either as music or as speech based on an analysis of the energy and the frequency of the audio signal.

If an audio signal consists only of speech or only of music, it will be satisfactory to use the same coding model for the entire signal based on such a music/speech classification. In many other cases, however, the audio signal that is to be encoded is a mixed type of audio signal. For example, speech may be present at the same time as music and/or be alternating with music in the audio signal.

In these cases, a classification of entire source signals into music or a speech category is a too limited approach. Switching between the coding models when coding the audio signal can then only maximize the overall audio quality. That is, the ACELP model is partly used as well for coding a source signal classified as an audio signal other than speech, while the TCX model is partly used as well for a source signal classified as a speech signal.

The extended AMR-WB (AMR-WB+) codec is designed as well for coding such mixed types of audio signals with mixed coding models on a frame-by-frame basis.

The selection of coding models in AMR-WB+ can be carried out in several ways.

In the most complex approach, the signal is first encoded with all possible combinations of ACELP and TCX models. Next, the signal is synthesized again for each combination. The best excitation is then selected based on the quality of the synthesized speech signals. The quality of the synthesized speech resulting with a specific combination can be measured for example by determining its signal-to-noise ratio (SNR). This analysis-by-synthesis type of approach will provide good results. In some applications, however, it is not practicable, because of its very high complexity. The complexity results largely from the ACELP coding, which is the most complex part of an encoder.

In systems like MMS, for example, the full closed-loop analysis-by-synthesis approach is far too complex to perform. In an MMS encoder, therefore, a low complex open-loop method is employed for determining whether an ACELP coding model or a TCX model is selected for encoding a particular frame.

AMR-WB+ offers two different low-complex open-loop approaches for selecting the respective coding model for each frame. Both open-loop approaches evaluate source signal characteristics and encoding parameters for selecting a respective coding model.

In the first open-loop approach, an audio signal is first split up within each frame into several frequency bands, and the relation between the energy in the lower frequency bands and the energy in the higher frequency bands is analyzed, as well as the energy level variations in those bands. The audio content in each frame of the audio signal is then classified as a music-like content or a speech-like content based on both of the performed measurements or on different combinations of these measurements using different analysis windows and decision threshold values.

In the second open-loop approach, which is also referred to as model classification refinement, the coding model selection is based on an evaluation of the periodicity and the stationary properties of the audio content in a respective frame of the audio signal. Periodicity and stationary properties are evaluated more specifically by determining correlation, Long Term Prediction (LTP) parameters and spectral distance measurements.

If the signal properties are analyzed with an open-loop approach for selecting either ACELP or TCX, and TCX is selected for encoding, it is still necessary to define the to be used TCX frame length one of 20 ms, 40 ms or 80 ms. The optimal frame length for TCX, however, is very difficult to select based on signal characteristics in an open-loop approach.

It would thus be possible to select only the TCX frame lengths in the above-mentioned analysis-by-synthesis approach. In systems requiring low complex techniques, however, the analysis-by-synthesis approach is too complex, even if it is only used for the selection of TCX frame lengths.

SUMMARY OF THE INVENTION

It is an object of the invention to enable an efficient and simple selection of a coding frame length that is to be used for encoding a section of an audio signal.

A method for supporting an encoding of an audio signal is proposed, wherein at least one section of the audio signal is to be encoded with a coding model that allows the use of different coding frame lengths. The proposed method comprises determining at least one control parameter based at least partly on signal characteristics of the audio signal. The proposed method further comprises limiting the options of possible coding frame lengths for the at least one section by means of the at least one control parameter.

Moreover, a module for supporting an encoding of an audio signal is proposed, wherein at least one section of the audio signal is to be encoded with a coding model which allows the use of different coding frame lengths. The module comprises a parameter selection portion adapted to determine at least one control parameter based at least partly on signal characteristics of the audio signal. The module further comprises a frame length selection portion adapted to limit options of possible coding frame lengths for at least one section of the audio signal by means of at least one control parameter provided by the first evaluation portion. This module can be for instance an encoder or a part of an encoder.

Moreover, an electronic device is proposed, which comprises such a module.

Moreover, an audio coding system is proposed which comprises such a module and in addition a decoder for decoding audio signals which have been encoded with variable coding frame lengths.

Finally, a software program product is proposed, in which a software code for supporting an encoding of an audio signal is stored. At least one section of the audio signal is to be encoded with a coding model, which allows the use of different coding frame lengths. When running in a processing component of an encoder, the software code realizes the steps of the proposed method.

The invention proceeds from the consideration that while the final determination of a coding frame length for a specific section of an audio signal can frequently not be determined based on signal characteristics, such signal characteristics allow nevertheless a pre-selection of suitable coding frame lengths. It is therefore proposed that at least one control parameter is determined based on signal characteristics for a respective section of an audio signal, and that this at least one control parameter is used for limiting the available coding frame length options.

It is an advantage of the invention that it reduces the number of coding frame length options with an approach having a low complexity. The reduction of the coding frame length options, one the other hand, reduces the complexity of the final selection of the to be used coding frame length.

In one embodiment of the invention, the final selection of the coding frame length is performed with an analysis-by-synthesis approach. That is, in case more than one option of possible coding frame lengths remains after the proposed limitation, each of the remaining transform coding frame lengths is used for encoding the at least one section. The resulting encoded signals are then decoded again with the respectively used transform coding frame length. Now, the coding frame length which results in the best decoded audio signal in the at least one section can be selected.

Due to the preceding limitation, the number of required analysis-by-synthesis rounds can be reduced significantly compared to the above mentioned full closed-loop approach. As a result, also the overall complexity of an encoder, in which the invention is implemented, is reduced.

The best-decoded audio signal can be determined in various ways. It can be determined for example by comparing an SNR resulting with each of the remaining coding frame lengths. The SNR can be determined easily and provides a reliable indication of the signal quality.

In case several coding models can be employed for coding the audio signal, for example a TCX model and an ACELP coding model, it has to be determined as well which coding model is to be employed for which section of the audio signal. This can be achieved in a low complex manner based on audio signal characteristics for a respective section, as mentioned above. The number and/or the position of the sections for which the other coding model than the one allowing the use of different coding frame length is to be used can then be used as well as control parameter for limiting the coding frame length options.

For example, the coding frame length cannot exceed the size of the section or sections between two sections for which the other coding model was selected.

In a further embodiment of the invention, the coding frame length is only selected within a respective supersection comprising a predetermined number of sections. In this case, the coding frame length options for a particular section can be limited as well based on knowledge about the boundaries of the supersection to which the section belongs.

Such a supersection can be for instance a superframe, which comprises as sections four audio signal frames, each audio signal frame having a length of 20 ms. In case the coding model is a TCX model, it may allow coding frame lengths of 20 ms, 40 ms and 80 ms. If in this case, for example, an ACELP coding model has been selected for the second audio signal frame in a superframe, it is known that the third audio signal frame can be coded at the most with a coding length of 20 ms or, together with the fourth audio signal frame, of 40 ms.

In another advantageous embodiment of the invention, an indicator indicating whether a shorter or a longer coding frame length is to be employed gives a further control parameter. An indication that a shorter coding frame length is to be employed excludes then at least a longest coding frame length option, while an indication that a longer coding frame length is to be employed excludes at least a shortest coding frame length option.

BRIEF DESCRIPTION OF THE FIGURES

Other objects and features of the present invention will become apparent from the following detailed description considered in conjunction with the accompanying drawings.

FIG. 3 is a first table illustrating a constraint of mode combinations based on control parameters in accordance with the invention; and FIG. 4 is a second table illustrating a constraint of mode combinations based on control parameters in accordance with the invention.

DETAILED DESCRIPTION OF THE INVENTION

Figure 1:
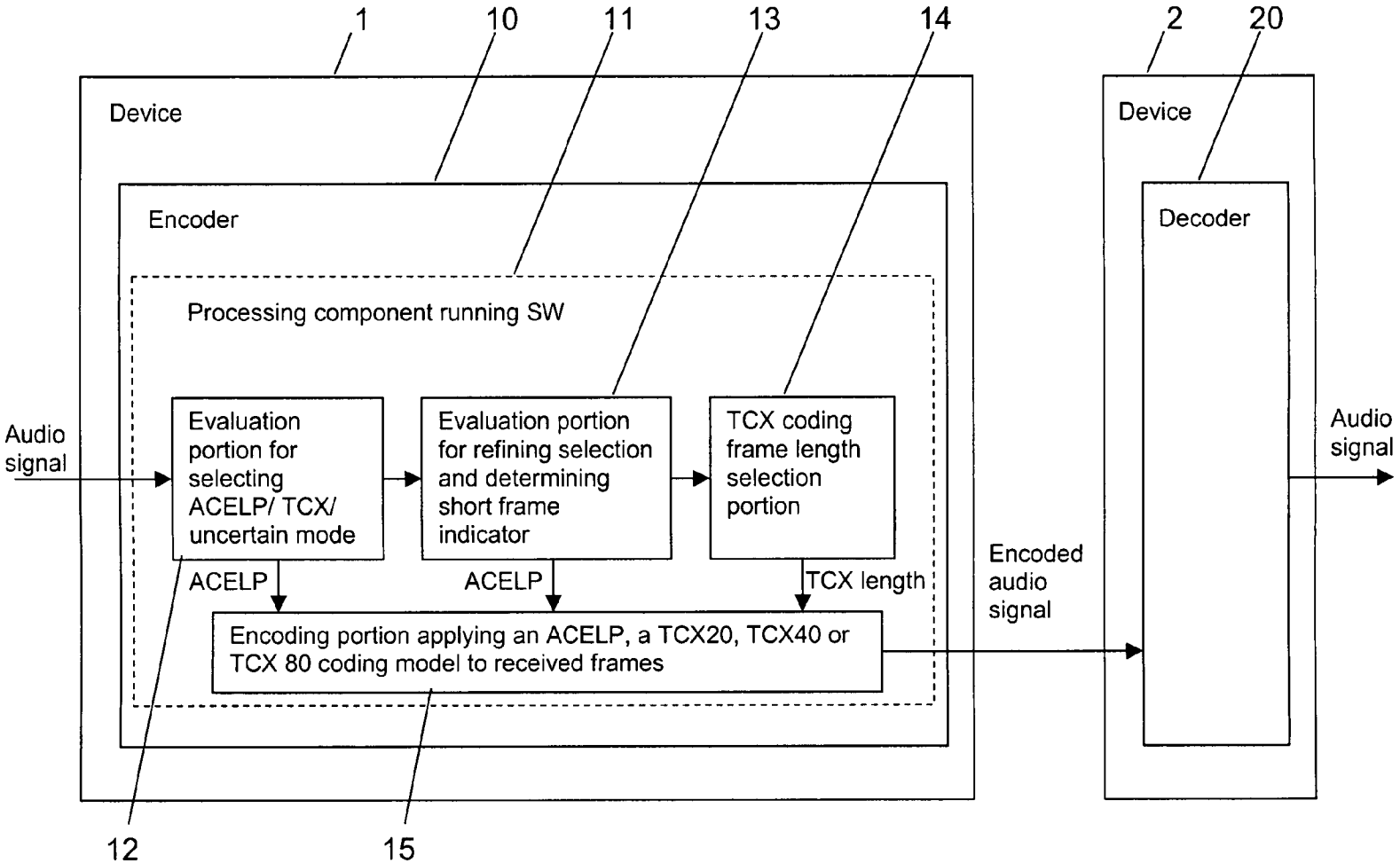
FIG. 1 is a schematic diagram of an audio coding system according to an embodiment of the invention.

FIG. 1 is a schematic diagram of an audio coding system according to an embodiment of the invention, which allows a selection of the coding frame length of a transform coding model.

The system comprises a first device 1 including an AMR-WB+ encoder 10 and a second device 2 including an AMR-WB+ decoder 20. The first device 1 can be for instance an MMS server, while the second device 2 can be for instance a mobile phone.

The first device 1 comprises a first evaluation portion 12 for a first selection of a coding model in an open loop approach. The first device 1 moreover comprises a second evaluation portion 13 for refining the first selection in a further open loop approach and for determining in parallel a short frame indicator as one control parameter. The first evaluation portion 12 and the second evaluation portion 13 form together a parameter selection portion. The first device 1 moreover comprises a TCX frame length selection portion 14 for limiting the coding frame length options in case a TCX model is selected and for selecting among the remaining options the best one in a closed-loop approach. The first device 1 moreover comprises an encoding portion 15. The encoding portion 15 is able to apply an ACELP coding model, a TCX20 model using a TCX frame length of 20 ms, a TCX40 model using a TCX frame length of 40 ms or a TCX80 model using a TCX frame length of 80 ms to received audio frames.

The first evaluation portion 12 is linked to the second evaluation portion 13 and to the encoding portion 15. The second evaluation portion 13 is moreover linked to the TCX frame length selection portion 14 and to the encoding portion 15. The TCX frame length selection portion 14 is linked as well to the encoding portion 15.

It is to be understood that the presented portions 12 to 15 are designed for encoding a mono audio signal, which may have been generated from a stereo audio signal. Additional stereo information may be generated in additional stereo extension portions not shown. It is moreover to be noted that the encoder 10 comprises further portions not shown. It is moreover to be understood that the presented portions 12 to 15 do not have to be separate portions, but can equally be interweaved among each other's or with other portions.

The portions 12, 13, 14 and 15 can be realized in particular by a software (SW) run in a processing component 11 of the encoder 10, which is indicated by dashed lines.

Figure 2:
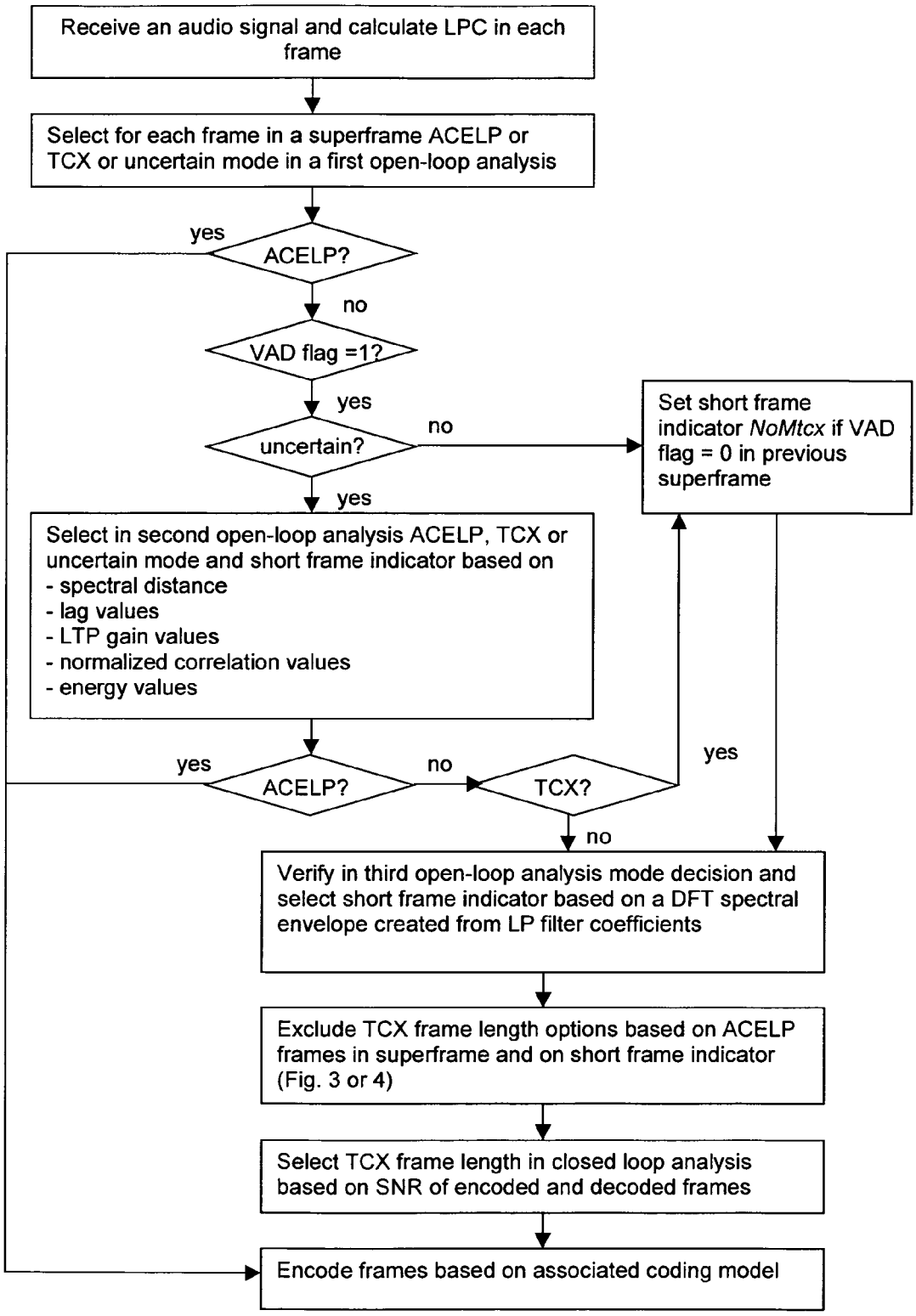
FIG. 2 is a flow chart illustrating an embodiment of the method according to the invention implemented in the system of FIG. 1.

The processing in the encoder 10 will now be described in more detail with reference to the flow chart of FIG. 2.

The processing is performed for a respective superframe. Each superframe has a length of 80 ms and comprises four consecutive audio signal frames.

The encoder 10 receives an audio signal which has been provided to the first device 1. The audio signal is converted into a mono audio signal and a linear prediction (LP) filter calculates a linear prediction coding (LPC) in each frame to model the spectral envelope.

The first evaluation portion 12 for each frame of the superframe in a first open-loop analysis processes the resulting LPC excitation output by the LP filter. This analysis determines based on source signal characteristics whether the content of the respective frame can be assumed to be speech or other audio content, like music. The analysis can be based for instance on an evaluation of the energy in different frequency bands, as mentioned above. For each frame that can be assumed to comprise speech, an ACELP coding model is selected, while for each frame which can be assumed to comprise another audio content, a TCX model is selected. There is no separation at this point of time between TCX models using different coding frame lengths. For those frames for which the analyzed characteristics do not indicate clearly a speech or another audio content, an uncertain mode is selected.

The first evaluation portion 12 informs the encoding portion 15 about all frames for which the ACELP model has been selected so far.

The second evaluation portion 13 then performs a second open-loop analysis on a frame-by-frame basis for a further separation into ACELP and TCX frames based on signal characteristics. In parallel, the second evaluation portion 13 determines a short frame indicator flag NoMtcx as one control parameter. If the flag NoMtcx is set, the usage of TCX80 is disabled.

The processing in the second evaluation portion 13 is only carried out for a respective frame if a voice activity indicator VAD flag is set for the frame and if the first evaluation portion 12 has not selected the ACELP coding model for this frame.

If the output of the first open-loop analysis by the first evaluation component 12 has been the uncertain mode, first a spectral distance is calculated and a variety of available signal characteristics are gathered.

The spectral distance $SD_n$ of the current frame n is calculated from Immittance Spectral Pair (ISP) parameters according to the following equation:

$$SD(n) = \sum_{i=0}^{N} |ISP_n(i) - ISP_{n-1}(i)|,$$

Where $ISP_n$ is the ISP coefficients vector of frame n and where $ISP_n(i)$ is $i^{th}$ element of this vector. The ISP parameters are available anyhow, as the LP coefficients are transformed to the ISP domain for quantization and interpolation purposes.

The parameter $Lag_n$ contains two open loop lag values of the current frame n. Lag is the long term filter delay. It is typically the true pitch period, or its multiple or sub-multiple. An open-loop pitch analysis is performed twice per frame, that is, each 10 ms, to find two estimates of the pitch lag in each frame. This is done in order to simplify the pitch analysis and to confine the closed loop pitch search to a small number of lags around the open-loop estimated lags.

Further, $LagDif_{buf}$ is a buffer containing the open loop lag values of the previous ten frames of 20 ms.

The parameter $Gain_n$ contains two LTP gain values of the current frame n.

The parameter $NormCorr_n$ contains two normalized correlation values of the current frame n.

The parameter $MaxEnergy_{buf}$ is the maximum value of a buffer containing energy values. The energy buffer contains the energy values of the current frame n and of the five preceding frames, each having a length of 20 ms.

Now, the coding modes are selected and the control parameter NoMtcx is set according to the following open-loop algorithm:

```
if (SD_n > 0.2)
    Mode = ACELP_MODE;
else
    if (LagDif_buf < 2)
        if (Lag_n == HIGH LIMIT or Lag_n == LOW LIMIT) {
            if (Gainn−NormCorr_n<0.1 and NormCorr_n>0.9)
                Mode = ACELP_MODE
            else
                Mode = TCX_MODE
    else if (Gainn− NormCorr_n < 0.1 and NormCorr_n > 0.88)
        Mode = ACELP_MODE
    else if (Gain_n − NormCorr_n > 0.2)
        Mode = TCX_MODE
    else
        NoMtcx = NoMtcx +1
if (MaxEnergybuf < 60 )
    if (SD_n > 0.15)
        Mode = ACELP_MODE;
    else
        NoMtcx = NoMtcx +1.
```

Thus, various signal characteristics and their combinations are compared to various predetermined threshold values, in order to determine whether an uncertain mode frame contains speech content or other audio content and to assign the appropriate coding model. Similarly, the short frame indicator flag NoMtcx is set depending on some of these signal characteristics and their combinations.

If the output of the first open-loop analysis by the first evaluation component 12 has been the TCX mode, in contrast, it is determined whether the VAD flag had been set to zero for at least one frame in the preceding superframe. If this is the case, the short frame indicator flag NoMtcx is equally set to '1'.

If the coding mode for the current frame has been set by now to the TCX mode or is still set to the uncertain mode, the mode decision is further verified. To this end, first a discrete Fourier transformed (DFT) spectral envelope vector mag is created from the LP filter coefficients of the current frame. The verification of the coding mode is then performed according to the following algorithm:

```
if (Gain_n − NormCorr_n < 0.006 and NormCorr_n > 0.92 and Lag_n
> 21)
    DFTSum = 0;
    for (i=1; i<40; i++) {
        DFTSum = DFTSum + mag[i];
    if (DFTSum > 95 and mag[0] < 5) {
        Mode = TCX_MODE;
    else
        Mode = ACELP_MODE;
        NoMtcx = NoMtcx +1
```

The final sum DFTSum is thus the sum of the first 40 elements of the vector mag, excluding the first element mag (0) in the vector mag.

The second evaluation portion 13 informs the encoding portion 15 about all frames for which the ACELP model has been selected in addition.

In the TCX frame length selection portion 14, first control parameters are evaluated for limiting the number of TCX frame length options.

One control parameter is the number of ACELP modes selected in the superframe. In case the ACELP coding model has been selected for four frames in the superframe, there remains no frame for which a TCX frame length has to be determined. In case the ACELP coding model has been selected for three frames in the superframe, the TCX frame length is set to 20 ms.

Further limitations are carried out based on the table of FIG. 3 or FIG. 4. FIGS. 3 and 4 present a respective table of five columns associating selectable TCX frame lengths to various combinations of selected coding modes.

Both tables show in a first column seven possible combinations of selected coding modes for the four frames of a superframe. In each of the combinations, at the most two ACELP modes have been selected. The combinations are (0,1,1,1), (1,0,1,1), (1,1,0,1), (1,1,1,0), (1,1,0,0), (0,0,1,1) and (1,1,1,1), the last one occurring twice. In this representation of the selected combinations a '0' represents an ACELP mode and a '1' a TCX mode.

The respective fourth column presents the control parameter Aind, which indicates for each combination in the first column the number of selected ACELP modes. It can be seen that only mode combinations associated to Aind values of '0', '1' and '2' are present, since in case of values of '3' or '4', the TCX frame length selection portion 14 can select the TCX frame length immediately without further processing.

The respective fifth column presents the short frame indicator flag NoMtcx. This parameter is only evaluated by the TCX frame length selection portion 14 in case the control parameter Aind has a value of '0', that is in case ACELP mode was selected for no frame of the superframe.

The respective second and third column show for each combination the TCX frame lengths which are allowed to be selected for the TCX mode frames in view of the constraints by the control parameters. For each combination in the first column, at the most two TCX frame lengths have to be checked. In these TCX frame lengths combinations, a '0' represents a 20 ms ACELP coding frame, a '1' a 20 ms TCX frame, a sequence of two '2's a 40 ms TCX frame, and a sequence of four '3's an 80 ms TCX frame.

For the first combination of modes (0,1,1,1), for example, the combination of coding frame lengths (0,1,1,1) and (0,1,2,2) are allowed. That is, either the second, third and fourth frames are coded with a 20 ms TCX frame, or only the second frame is coded with a 20 ms TCX frame, while the third and fourth frame are coded with a 40 ms TCX frame.

Similarly, for the second combination of modes (1,0,1,1), the combination of coding frame lengths (1,0,1,1) and (1,0,2,2) is allowed. For the third combination of modes (1,1,0,1) the combination of coding frame lengths (1,1,0,1) and (2,2,0,1) are allowed. For the fourth combination of modes (1,1,1,0) the combination of coding frame lengths (1,1,1,0) and (2,2,1,0) are allowed. For the fifth combination of modes (1,1,0,0) the combination of coding frame lengths (1,1,0,0) and (2,2,0,0) are allowed. For the sixth combination of modes (0,0,1,1) the combination of coding frame lengths (0,0,1,1) and (0,0,2,2) are allowed.

For the seventh combination of modes (1,1,1,1), the short frame indicator flag NoMtcx indicates whether to try longer or shorter TCX frame lengths. The flag NoMtcx is set for the superframe, in case the second evaluation portion 13 for at least one of the frames of the superframe has set it. If the flag NoMtcx is set for the superframe, only short frame lengths are allowed.

In the table of FIG. 3, this means that the TCX frame length selection portion 14 selects immediately a TCX frame length of 20 ms for the entire superframe. That is, the only allowed combination of TCX frame lengths is (1,1,1,1). In the table of FIG. 4, a set flag NoMtcx means that the combination of TCX frame lengths (1,1,1,1) and in addition the combination of TCX frame lengths (2,2,2,2) are allowed, the latter representing two TCX frames of 40 ms.

If the short frame indicator flag NoMtcx is not set, only long TCX frame lengths are allowed. In the tables of FIG. 3 and FIG. 4, this means that the combination of TCX frame lengths (2,2,2,2) and (3,3,3,3) are allowed, the latter representing a single TCX frame of 80 ms.

Clear music mostly requires longer TCX frames for an optimal coding, and speech is obviously coded best by ACELP. Especially at the beginning of music and/or speech, when the energy is low or a voice activity indicator VAD was set to zero in previous frames, longer TCX frames used for coding speech degrade the speech quality. Short TCX frames of 20 ms, on the other hand, are relatively good for music and certain speech segments. With some signal characteristics, it is difficult to determine whether a frame content is music or speech. Therefore, a short TCX frame is a good alternative to the optimal coding model in such a case, because it is suitable for both types of content. Thus, a short frame indicator is well suited as a control parameter.

Further combinations of coding frame lengths for the presented combinations of modes are prevented by the encoder structure, in which a TCX40 model for the middle audio signal frames is not allowed.

Similarly, further combinations of modes with Aind<3 not represented in FIGS. 3 and 4 allow only a single combination of coding frame lengths, either by themselves or due to the encoder structure. That is, a combination of modes (1,0,0,1) only allows a combination of coding frame lengths of (1,0,0,1) and a combination of modes (0,1,1,0) only allows a combination of coding frame lengths of (0,1,1,0).

As the control parameters Aind and NoMtcx constrain the mode combinations with respect to the TCX frame lengths, at the most two-frame length have to be checked for each superframe.

In case there remain two possible TCX frame length combinations, an SNR-type of algorithm is used in the TCX frame length selection portion 14 to find the optimum TCX model or models for the superframe.

For evaluating the selectable TCX frame lengths, the frames in the superframe for which TCX mode has been selected are encoded using a transform coding with both allowed TCX frame length combinations. The TCX is based by way of example on a fast Fourier transform (FFT). The encoded signals are decoded again, and the results for both TCX frame lengths are then compared based on a segmental SNR.

The segmental SNR is the SNR of one subframe of a TCX frame. The subframe has a length of N, which corresponds to a 5 ms subframe of the original audio signal.

The segmental SNR in subframe i, $segSNR_i$, is determined for each subframe of a TCX frame according to the following equation:

$$segSNR_i = 20\log_{10}\left(\frac{\sum_{n=0}^{N-1} x_w^2(n)}{\sum_{n=0}^{N-1}\left(x_w(n)-\hat{x}_w(n)\right)^2}\right)$$

In this equation, $x_w(n)$ is the amplitude of the digitized original audio signal at position n in the subframe, while $\hat{x}_w(n)$ is the amplitude of the encoded and decoded audio signal at position n in the subframe.

Thereupon, the average segmental SNR over all subframes in a TCX frame is determined according to the following equation:

$$\overline{segSNR} = \frac{1}{N_{SF}}\sum_{i=0}^{N_{SF}-1} segSNR_i$$

Where $N_{SF}$ is the number of subframes in the TCX frame. Since a TCX frame can have a length of 20 ms, 40 ms or 80 ms, $N_{SF}$ can be 4, 8 or 16.

The TCX frame length selection portion 14 then determines which one of the allowed TCX frame lengths for a certain number of audio signal frames results in a better average SNR. For example, in case two audio signal frames could be encoded with a TCX20 model each or together with a TCX40 model, the averaged SNR of the TCX40 frame is compared to the averaged SNR sum for both TCX20 frames. The TCX frame length resulting in a higher averaged SNR is selected and reported to the encoding portion 15.

The encoding portion 15 encodes all frames of the audio signal with the respectively selected coding model, indicated either by the first evaluation portion 12, the second evaluation portion 13 or the TCX frame length selection portion 14. The TCX is based by way of example on an FFT using the selected coding frame length, and the ACELP coding uses by way of example an LTP and fixed codebook parameters for an LPC excitation.

The encoding portion 15 then provides the encoded frames for a transmission to the second device 2. In the second device 2, the decoder 20 decodes all received frames with the ACELP coding model or with one of the TCX models. The decoded frames are provided for example for presentation to a user of the second device 2.

The presented TCX frame length selection is thus based on a semi closed-loop approach, in which the basic type of the coding model and control parameters are selected in an open-loop method, while the TCX frame length is then selected from a limited number of options with a closed-loop approach. While in a full closed-loop analysis, the analysis-by-synthesis is always performed four times per superframe, in the presented semi closed-loop approach, an analysis-by-synthesis has to be performed at the most twice per superframe.

It is to be noted that the described embodiment constitutes only one of a variety of possible embodiments of the invention.

What is claimed is:

1. A method comprising:

determining, by an electronic device, for an encoding of a frame of an audio signal with a coding model that allows the use of different coding frame lengths at least one control parameter based at least on signal characteristics of said audio signal and on the number of audio signal frames in a superframe selected to be coded with another coding model, each superframe comprising a predetermined number of audio signal frames;

limiting, by said electronic device, options of possible coding frame lengths for said at least one audio signal frame by means of said at least one control parameter, said limitation resulting in a plurality of remaining options;

selecting, by said electronic device, a coding frame length for said audio signal frame from said remaining options; and coding, using at least one of said coding model and at least one other coding model, in said superframe.

2. The method according to claim 1, wherein selecting a coding frame length for said audio signal frame from said remaining options comprises:

encoding said at least one audio signal frame with each of said coding frame lengths, which remain as options of possible coding frame lengths after said limitation;

decoding said encoded audio signal frames with the respectively used coding frame length; and selecting for said at least one audio signal frame a coding frame length which results in the best-decoded audio signal in said at least one audio signal frame.

3. The method according to claim 2, wherein a coding frame length which results in the best decoded audio signal frame is determined by comparing a signal-to-noise ratio resulting for each of said coding frame lengths.

4. The method according to claim 3, wherein for said signal-to-noise ratio of an audio signal obtained with a particular coding frame length, first a segmental signal-to-noise ratio is determined separately for a plurality of subframes in a respective coding frame, and wherein said segmental signal-to-noise ratios of said subframes of a coding frame are then averaged for the entire coding frame to obtain said signal-to-noise ratio for said at least one audio signal frame.

5. The method according to claim 1, further comprising a step of determining for each audio signal frame of said audio signal, based on audio signal characteristics for a respective audio signal frame, whether said coding model or another coding model is to be employed, wherein said at least one control parameter comprises an indication of the audio signal frames for which said other coding model has been selected.

6. The method according to claim 5, wherein said coding model is a transform coding model and wherein said other coding model is an Algebraic Code-Excited Linear Prediction coding model.

7. The method according to claim 6, wherein each audio signal frame of said audio signal has a length of 20 ms, wherein four consecutive audio signal frame, respectively, form a superframe, wherein said transform coding model allows the use of coding frame lengths of 20 ms, 40 ms and 80 ms, and wherein said coding frame length options for a audio signal frame are limited by the boundaries of the superframe to which said audio signal frame belongs.

8. The method according to claim 5, wherein each frame of said audio signal has a predetermined length and wherein said indication of the audio signal frames for which said other coding model has been selected is provided for a respective superframe.

9. The method according to claim 1, wherein each audio signal frame of said audio signal has a predetermined length, and wherein said coding frame length options for a particular audio signal frame are limited by the boundaries of the superframe to which said audio signal frame belongs.

10. The method according to claim 1, wherein said at least one control parameter comprises an indicator indicating whether a shorter or a longer coding frame length is to be employed, an indication that a shorter coding frame length is to be employed excluding at least a longest coding frame length option and an indication that a longer coding frame length is to be employed excluding at least a shortest coding frame length option.

11. The method according to claim 1, wherein the at least one control parameter is determined for encoding of a frame of an audio signal in the superframe.

12. An apparatus comprising:

a processing component and a non-transitory software program product in which a software code is stored;

the software, executed by the processing component, to cause the apparatus for an encoding of a frame of an audio signal with a coding model that allows the use of different coding frame lengths to determine at least one control parameter based at least on signal characteristics of said audio signal and on the number of audio signal frames in a superframe selected to be coded with another coding model, each superframe comprising a predetermined number of audio signal frames;

the software, executed by the processing component, to cause the apparatus to limit options of possible coding frame lengths for at least one audio signal frame by means of said at least one control parameter, said limitation resulting in one or more remaining options;

the software, executed by the processing component to cause the apparatus to select a coding frame length for said audio signal frame from said remaining options, in case more than one option of possible coding frame lengths remains after said limitation; and the software, executed by the processing component, to cause the apparatus to code, using at least one of said coding model and at least one other coding model in said superframe.

13. The apparatus according to claim 12, the software, executed by the processing component, to cause the apparatus to encode said at least one audio signal frame with each of said remaining coding frame lengths in case more than one option of possible coding frame lengths remains after said limitation, to decode said encoded audio signal frames again with the respectively used coding frame, and to select for said at least one audio signal frame a coding frame length which results in the best decoded audio signal in said at least one audio signal frame.

14. The apparatus according to claim 13, the software, executed by the processing component, to cause the apparatus to determine a coding frame length which results in the best decoded audio signal frame is determined by comparing a signal-to-noise ratio resulting for each of said coding frame lengths.

15. The apparatus according to claim 14, wherein for determining said signal-to-noise ratio of an audio signal obtained with a particular coding frame length, the software, executed by the processing component to cause the apparatus to determine first a segmental signal-to-noise ratio separately for a plurality of subframes in a respective coding frame, and to average said segmental signal-to-noise ratios of said subframes of a coding frame for the entire coding frame to obtain said signal-to-noise ratio for said at least one audio signal frame.

16. The apparatus according to claim 12, the software, executed by the processing component, to cause the apparatus to determine at least for some frames of an audio signal, based on audio signal characteristics for a respective frame of said audio signal, whether said coding model or another coding model is to be employed, and to provide as one of said at least one control parameter an indication of the audio signal frames for which said other coding model has been selected.

17. The apparatus according to claim 16, wherein said coding model is a transform coding model and wherein said other coding model is an Algebraic Code-Excited Linear Prediction coding model.

18. An audio coding system comprising an apparatus according to claim 12 and a decoder for decoding audio signals which have been encoded with variable coding frame lengths.

19. The audio coding system according to claim 18 further comprising determination of at least one control parameter based at least partly on signal characteristics of said audio signal.

20. The audio coding system according to claim 18 further comprising limiting said options of possible coding frame lengths by means of said at least one control parameter.

21. The audio coding system according to claim 19, further comprising in case more than one option of possible coding frame lengths remains after said limitation, encoding said at least one audio signal frame with each of said remaining transform coding frame lengths;

decoding said encoded audio signal frames with the respectively used transform coding frame length; and selecting for said at least one audio signal frame a coding frame length which results in the best-decoded audio signal in said at least one audio signal frame.

22. The apparatus according to claim 16, wherein each frame of said audio signal has a predetermined length and wherein the software executed by the processing component, to cause the apparatus to provide an indication of the audio signal frames for which said other coding model has been selected for a respective superframe comprising a predetermined number of said audio signal frames.

23. The apparatus according to claim 12, wherein each frame of said audio signal has a predetermined length, and wherein the software, executed by the processing component, to cause the apparatus to limit the coding frame length options for a particular audio signal frame based on the boundaries of the superframe to which said audio signal frame belongs.

24. The apparatus according to claim 23, wherein each frame of said audio signal has a length of 20 ms, wherein four consecutive frames, respectively, form a superframe, wherein said transform coding model allows the use of coding frame lengths of 20 ms, 40 ms and 80 ms, and the software executed by the processing component, to cause the apparatus to limit the coding frame length options for a audio signal frame based on the boundaries of the superframe to which said audio signal frame belongs.

25. The apparatus according to claim 12, the software, executed by the processing component, to cause the apparatus to provide as one of said at least one control parameter an indicator indicating whether a shorter or a longer coding frame length is to be employed, an indication that a shorter coding frame length is to be employed excluding at least a longest coding frame length option and an indication that a longer coding frame length is to be employed excluding at least a shortest coding frame length option.

26. The apparatus according to claim 12, the software, executed by the processing component to determine the at least one control parameter for encoding of a frame of an audio signal in the superframe.

27. An electronic device comprising an apparatus, said apparatus comprising:

a processing component and a non-transitory software program product in which a software code is stored;

the software, executed by the processing component, to cause the electronic device for an encoding of a frame of an audio signal with a coding model that allows the use of different coding frame lengths to determine at least one control parameter based at least on signal characteristics of said audio signal and on the number of audio signal frames in a superframe selected to be coded with another coding model, each superframe comprising a predetermined number of audio signal frames;

the software, executed by the processing component, to cause the electronic device to limit options of possible coding frame lengths for at least one audio signal frame by means of said at least one control parameter, said limitation resulting in one or more remaining options;

the software, executed by the processing component, to cause the electronic device to select a coding frame length for said audio signal frame from said remaining options, in case more than one option of possible coding frame lengths remains after said limitation; and the software, executed by the processing component, to cause the apparatus to code, using at least one of said coding model and at least one other coding model in said superframe.

28. The electronic device according to claim 27, wherein the software, executed by the processing component, to cause the electronic device to encode said at least one audio signal frame with each of said remaining coding frame lengths in case more than one option of possible coding frame lengths remains after said limitation, to decode said encoded audio signal frames again with the respectively used coding frame, and to select for said at least one audio signal frame a coding frame length which results in the best decoded audio signal in said at least one audio signal frame.

29. The electronic device according to claim 28, wherein the software, executed by the processing component, to cause the electronic device to determine a coding frame length which results in the best decoded audio signal frame is determined by comparing a signal-to-noise ratio resulting for each of said coding frame lengths.

30. The electronic device according to claim 29, wherein for determining said signal-to-noise ratio of an audio signal obtained with a particular coding frame length, the software, executed by the processing component, to cause the electronic device to determine first a segmental signal-to-noise ratio separately for a plurality of subframes in a respective coding frame, and to average said segmental signal-to-noise ratios of said subframes of a coding frame for the entire coding frame to obtain said signal-to-noise ratio for said at least one audio signal frame.

31. The electronic device according to claim 28, wherein the software, executed by the processing component, to cause the electronic device to determine at least for some frames of an audio signal, based on audio signal characteristics for a respective frame of said audio signal, whether said coding model or another coding model is to be employed, and to provide as one of said at least one control parameter an indication of the audio signal frames for which said other coding model has been selected.

32. The electronic device according to claim 31, wherein said coding model is a transform coding model and wherein said other coding model is an Algebraic Code-Excited Linear Prediction coding model.

33. The electronic device according to claim 28, wherein the electronic device is a server.

34. An apparatus comprising:

means, implemented at least partly in hardware, for determining for an encoding of a frame of an audio signal with a coding model that allows the use of different coding frame lengths at least one control parameter based at least on signal characteristics of said audio signal and on the number of audio signal frames in a superframe selected to be coded with another coding model, each superframe comprising a predetermined number of audio signal frame;

means, implemented at least partly in hardware, for limiting options of possible coding frame lengths for at least one audio signal frame by means of at least one control parameter provided by said means for determining at least one control parameter, said limitation resulting in one or more remaining options; and means, implemented at least partly in hardware, for selecting a coding frame length for said audio signal frame from said remaining options, in case more than one option of possible coding frame lengths remains after said limitation; and means for coding, using at least one of said coding model and at least one other coding model in said superframe.

35. A non-transitory software program product in which a software code is stored, said software code realizing the following when executed by a processing component of an encoder;

determining for an encoding of a frame of an audio signal with a coding model that allows the use of different coding frame lengths at least one control parameter based at least on signal characteristics of said audio signal and on the number of audio signal frames in a superframe selected to be coded with another coding model, each superframe comprising a predetermined number of audio signal frames;

limiting options of possible coding frame lengths for said at least one audio signal frame by means of said at least one control parameter said limitation resulting in one or more remaining options;

in case more than one option of possible coding frame lengths remains after said limitation, selecting a coding frame length for said audio signal frame from said limited options; and coding, using at least one of said coding model and at least one other coding model in said superframe.

* * * * *